US009297389B2

(12) United States Patent
Iwasaki et al.

(10) Patent No.: US 9,297,389 B2
(45) Date of Patent: Mar. 29, 2016

(54) METHOD OF MANUFACTURING MATERIAL FOR ROTARY MACHINE COMPONENT, METHOD OF MANUFACTURING ROTARY MACHINE COMPONENT, MATERIAL FOR ROTARY MACHINE COMPONENT, ROTARY MACHINE COMPONENT, AND CENTRIFUGAL COMPRESSOR

(75) Inventors: Shugo Iwasaki, Tokyo (JP); Yoshikazu Yamada, Tokyo (JP); Shinichiro Tokuyama, Tokyo (JP); Tatsuya Osawa, Shibukawa (JP); Seiichi Yarimizu, Osaka (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 327 days.

(21) Appl. No.: 13/697,111

(22) PCT Filed: May 12, 2011

(86) PCT No.: PCT/JP2011/060949

§ 371 (c)(1),
(2), (4) Date: Nov. 9, 2012

(87) PCT Pub. No.: WO2011/142423

PCT Pub. Date: Nov. 17, 2011

(65) Prior Publication Data

US 2013/0058773 A1 Mar. 7, 2013

(30) Foreign Application Priority Data

May 13, 2010 (JP) ..... 2010-111204

(51) Int. Cl.

| | |
|---|---|
| ***C21D 8/00*** | (2006.01) |
| ***C21D 6/00*** | (2006.01) |
| ***C22C 38/18*** | (2006.01) |
| ***C22C 38/40*** | (2006.01) |
| ***F04D 29/28*** | (2006.01) |
| ***C21D 6/02*** | (2006.01) |
| ***C21D 9/00*** | (2006.01) |
| ***C21D 9/40*** | (2006.01) |
| ***C22C 38/00*** | (2006.01) |
| ***F04D 29/02*** | (2006.01) |

(Continued)

(52) U.S. Cl.

CPC ..... *F04D 29/284* (2013.01); *C21D 1/25* (2013.01); *C21D 6/004* (2013.01); *C21D 6/02* (2013.01); *C21D 9/0068* (2013.01); *C21D 9/40* (2013.01); *C22C 38/00* (2013.01); *C22C 38/001* (2013.01); *C22C 38/02* (2013.01); *C22C 38/04* (2013.01); *C22C 38/44* (2013.01); *F04D 29/023* (2013.01); *C21D 9/34* (2013.01)

(58) Field of Classification Search

None

See application file for complete search history.

(56) References Cited

FOREIGN PATENT DOCUMENTS

| | | |
|---|---|---|
| JP | 56-108859 | 8/1981 |
| JP | 58-53062 | 11/1983 |

(Continued)

OTHER PUBLICATIONS

Machine-English translation of Japanese patent No. 05-302118, Hineno Minoru et al., Nov. 11, 1993.*

(Continued)

*Primary Examiner* — Deborah Yee

(74) *Attorney, Agent, or Firm* — Wenderoth, Lind & Ponack, L.L.P.

(57) ABSTRACT

A method of manufacturing a material for a rotary machine component, by performing at least a solution treatment on a material made of a duplex stainless steel, wherein, in the solution treatment, the material is heated to a temperature in a range of 950 to 1100° C. and is thereafter cooled to 700° C. at an average cooling rate of equal to or greater than 20° C./min.

9 Claims, 5 Drawing Sheets

(51) Int. Cl.

| | |
|---|---|
| ***C21D 1/25*** | (2006.01) |
| ***C22C 38/02*** | (2006.01) |
| ***C22C 38/04*** | (2006.01) |
| ***C22C 38/44*** | (2006.01) |
| *C21D 9/34* | (2006.01) |

(56) References Cited

FOREIGN PATENT DOCUMENTS

| | | |
|---|---|---|
| JP | 59-14099 | 4/1984 |
| JP | 1-142019 | 6/1989 |
| JP | 1-165750 | 6/1989 |
| JP | 3-122256 | 5/1991 |
| JP | 5-247592 | 9/1993 |
| JP | 5-302118 | 11/1993 |
| JP | 3227734 | 11/2001 |
| JP | 2003-171743 | 6/2003 |
| JP | 2004-150527 | 5/2004 |
| JP | 2004-167595 | 6/2004 |
| JP | 2004-520491 | 7/2004 |

OTHER PUBLICATIONS

Japanese Notice of Reasons for Rejection issued Jan. 7, 2014 in corresponding Japanese Patent Application No. 2010-111204 with English translation.

International Search Report issued Aug. 16, 2011 in International (PCT) Application No. PCT/JP2011/060949.

Japanese Notification (Submission of Information) mailed Apr. 24, 2012 in Japanese Patent Application No. 2010-111204 with English translation.

Written Opinion of the International Searching Authority issued Aug. 16, 2011 in International (PCT) Application No. PCT/JP2011/060949.

Francois Millet et al., "Superduplex Stainless Steel Use in Manufacturing Highly Sour Gas Centrifugal Compressors", The American Society of Mechanical Engineers, Unites States of America, 1996, 96-GT-272.

Kenzo Fukaura, "Study on the Structure and Strength Characteristics of Duplex Stainless Steel", Osaka University, Doctoral Dissertation, Report No. B3790, the degree awarded on Feb. 6, 1986.

Yasuhiro Maehara et al., "Precipitation Behavior of σ Phase in a Duplex Phase Stainless Steel", vol. 67, No. 3, 1981, pp. 577-586.

Shigeo Owaku, "Manual for Technology of Heat Treatment", Japanese Standards Association, Jan. 22, 2001, pp. 204-213.

Japanese Notification (Submission of Information) mailed Feb. 3, 2015 in Japanese Patent Application No. 2010-111204 with English translation.

* cited by examiner

METHOD OF MANUFACTURING MATERIAL FOR ROTARY MACHINE COMPONENT, METHOD OF MANUFACTURING ROTARY MACHINE COMPONENT, MATERIAL FOR ROTARY MACHINE COMPONENT, ROTARY MACHINE COMPONENT, AND CENTRIFUGAL COMPRESSOR

BACKGROUND OF INVENTION

1. Technical Field

The present invention relates to a method of manufacturing a material for a rotary machine component, a method of manufacturing a rotary machine component, a material for a rotary machine component, a rotary machine component, and a centrifugal compressor.

Priority is claimed on Japanese Patent Application No. 2010-111204, filed on May 13, 2010, the content of which is incorporated herein by reference.

2. Background Art

Hitherto, a rotary machine such as a centrifugal compressor is used for supplying gas to a turbine in a gas turbine, a process of injecting gas into the ground during extraction of crude oil from an oil field, and the like. Since a high load is exerted on the components used in such a rotary machine, a high-strength metal material is used as the material of a rotary machine component such as an impeller.

On the other hand, in a centrifugal compressor used in an oil well environment or the like, a large amount of components that accelerate corrosion of the metal material, for example, hydrogen sulfide ($H_2S$), carbon dioxide ($CO_2$), and chlorine (Cl) is contained in a process gas which is a supply fluid, and the impeller comes into contact with a corrosive aqueous solution in which such gases are dissolved. Therefore, in the impeller on which a high load is exerted during driving of the centrifugal compressor, corrosion occurs due to the corrosive components described above, and furthermore, there is a possibility of stress corrosion cracking occurring and resulting in fracture.

As a material that endures the oil well environment as described above, for example, there are an austenitic stainless steel and a Ni-base alloy, and such metal materials are used in an oil well pipe and the like. However, such materials have low strength and thus there is a problem in that the materials may not be applied to components used in a rotary machine such as an impeller of a centrifugal compressor.

Therefore, hitherto, as the material for the impeller of the centrifugal compressor, for example, a precipitation-hardening martensitic stainless steel such as 17-4 PH and a martensitic stainless steel such as SUSF6NM are applied. However, such materials never have high corrosion resistance, and as above, there is a possibility of corrosion or stress corrosion cracking occurring due to the corrosive components.

In addition, employing a material similar to SUS329J4L having corrosion resistance and the like as the metal material used in the impeller is proposed (for example, refer to Non Patent Document 1). However, even though such a material as described in Non Patent Document 1 is used, in a case where the proportion of corrosive components contained in a fluid increases, there is a possibility of corrosion or stress corrosion cracking occurring as above.

In addition, employing a precipitation-hardening Ni-base alloy such as Inconel 718 which has both corrosion resistance and strength as the material of the impeller is considered. However, the precipitation-hardening Ni-base alloy as described above is expensive, and thus there is a problem in that manufacturing cost is increased.

Here, a duplex stainless steel is known as a metal material which has sufficient corrosion resistance and strength and is relatively cheap in practice (for example, refer to Patent Documents 1 to 3). Therefore, in recent years, the duplex stainless steel has been appropriately used as materials for rotary machine components such as the impeller of the centrifugal compressor.

However, in a case where the duplex stainless steel as described above is used for a rotary machine component such as the impeller, there are problems which may be described as follows.

First, in a case where the duplex stainless steel is subjected to isothermal holding at about 450 to 1000° C., or to slow cooling at about 450 to 1000° C. in a welding process during manufacturing of components, various heat treatment processes, and the like, 475° C.-embrittlement or σ-embrittlement occurs. Therefore, the toughness of the material is degraded, and there is a problem in that cracking is likely to occur in a manufacturing process of a corresponding component or during driving of a rotary machine such as the centrifugal compressor.

In addition, it is known that in an annealing process which is performed after performing a welding process or a machining process during manufacturing of component after performing a solution treatment on a material made of the duplex stainless steel, in order to effectively remove residual stress, generally, it is appropriate to perform heating at as high a temperature as possible.

However, in a case where the duplex stainless steel material is held at a high temperature, 475° C.-embrittlement or σ-embrittlement occurs. Therefore, as above, there is a problem in that cracking is likely to occur during the manufacturing process of a corresponding component or during driving of a rotary machine (see the graph of FIG. 9). Therefore, hitherto, in the annealing process performed after the welding process or the machining process, a heat treatment is performed at a temperature of 300 to 400° C. which is insufficient to remove residual stress within a typical heat treatment time.

CITATION LIST

Patent Document

[Patent Document 1] Japanese Examined Patent Application, Second Publication No. S58-053062

[Patent Document 2] Japanese Examined Patent Application, Second Publication No. S59-014099

[Patent Document 3] Japanese Patent No. 3227734

Non-Patent Literature

[Non Patent Document 1] SUPERDUPLEX STAINLESS STEEL USE IN MANUFACTURING HIGHLY SOUR GAS CENTRIFUGAL COMPRESSORS, "THE AMERICAN SOCIETY OF MECHANICAL ENGINEERS", United States of America, 1996, 96-GT-272, by Francois Millet, et al.

SUMMARY OF INVENTION

Problems to be Solved by Invention

Here, the inventors have carried out intensive studies. As shown in the graph of FIG. 9, it becomes apparent that in a case where an annealing process of a duplex stainless steel is performed at a temperature of 300 to 400° C., high toughness (see the solid line in the graph) is obtained, whereas it is difficult to remove residual stress (see the broken line in the graph). Therefore, a rotary machine component such as the impeller, which is subjected to the annealing process under the above conditions, is in a state of holding high residual stress therein, and there is a possibility of cracking or fatigue failure occurring during driving of a rotary machine.

On the other hand, in a case where the annealing process of the duplex stainless steel is performed at a temperature of equal to or greater than 400° C., residual stress is sufficiently reduced, whereas toughness is degraded. Therefore, the rotary machine component such as the impeller, which is subjected to the annealing process under the above conditions, has a problem in that, as above, cracking is likely to occur during the manufacturing process of the corresponding component or during driving of the rotary machine.

In addition, hitherto, when the rotary machine component is manufactured, by performing casting and forging processes on a metal material in a material supply source, first, a round bar-like bloom is manufactured. After that, in a component working source, free-forging, shape-forging, and the like are performed on the bloom, thereby forming a rotary machine component having an impeller shape or the like. Here, in a case where the diameter of the bloom is too large, the cooling rate in the vicinity of the center of a thick material is reduced in a solution treatment. Therefore, there is a possibility of an embrittled phase being precipitated in the duplex stainless steel. Accordingly, in general, by causing the maximum diameter of the bloom to be about 300 mm and causing the dimensions from the surface of the material to the center portion thereof to be smaller than or equal to predetermined values, a cooling rate is secured, and the precipitation of an embrittled phase in a solution treatment is prevented. However, as described above, in the case where the diameter of the bloom is caused to be smaller than or equal to 300 mm, in the component working source, there is a problem in that the shape of an impeller formed by the forging process is limited.

SUMMARY OF INVENTION

The present invention has been made taking the foregoing circumstances into consideration, and an object thereof is to enable manufacture of a rotary machine component which has both low residual stress and high toughness, and in which occurrence of corrosion or stress corrosion cracking is suppressed even in a case where a fluid containing a corrosive component is supplied, by providing a method of manufacturing a material for a rotary machine component, a method of manufacturing a rotary machine component, a material for a rotary machine component, a rotary machine component, and a centrifugal compressor.

Solution to Problem

In order to accomplish the object, the invention employs the following configurations.

That is, a method of manufacturing a material for a rotary machine component according to a first aspect of the present invention, manufactures a material for a rotary machine component by performing at least a solution treatment on a material made of a duplex stainless steel, wherein, in the solution treatment, the material is heated to a temperature in a range of 950 to 1100° C. and is thereafter cooled to 700° C. at an average cooling rate of equal to or greater than 20° C./min.

In addition, in the method of manufacturing a material for a rotary machine component, it is more preferable that the average cooling rate in the solution treatment be equal to or greater than 30° C./min.

According to the method of manufacturing a material for a rotary machine component having the related configuration, a material for a rotary machine component which suppresses the precipitation of an embrittled phase and has high toughness may be manufactured by performing the solution treatment under the above conditions.

In the method of manufacturing a material for a rotary machine component according to a second aspect of the present invention, after the solution treatment, machining, and a heat treatment are performed on the material, an annealing process is further performed at a temperature in a range of 530 to 570° C.

In the method of manufacturing a material for a rotary machine component according to a third aspect of the present invention, a time taken to perform the annealing process is in a range of 1 to 12 hours, and more preferably, in a range of 4 to 8 hours.

According to the method of manufacturing a material for a rotary machine component having the related configuration, a material for a rotary machine component in which the residual stress of the material is reduced and high toughness is provided may be manufactured by performing the annealing process under the above conditions.

In the method of manufacturing a material for a rotary machine component according to a fourth aspect of the present invention, the material is a discoid material and has a thickness of smaller than or equal to 300 mm.

In the method of manufacturing a material for a rotary machine component according to a fifth aspect of the present invention, the solution treatment is performed after forming a through-hole in the discoid material in a thickness direction.

According to the method of manufacturing a material for a rotary machine component having the related configuration, the material is formed by directly forging an ingot which is a duplex stainless steel material to a shape having dimensions similar to those of the rotary machine component. Therefore, the material for a rotary machine component capable of being used to configure a rotary machine component in which the precipitation of an embrittled phase is suppressed and of which the toughness is excellent and which has a considerable thickness and a large diameter may be manufactured.

In addition, a material for a rotary machine component according to a sixth aspect of the present invention is manufactured according to the manufacturing method.

In addition, a rotary machine component according to a seventh aspect of the present invention is obtained by performing a predetermined working process on the material for a rotary machine component.

According to the material for a rotary machine component and the rotary machine component having the related configurations, since the material for a rotary machine component is obtained according to the manufacturing method and the rotary machine component is obtained by using the material for a rotary machine component, it is possible to obtain both low residual stress and high toughness.

A method of manufacturing a rotary machine component according to an eighth aspect of the present invention, manufactures a rotary machine component by performing at least a solution treatment on a material made of a duplex stainless steel at a predetermined temperature and thereafter performing a predetermined working process thereon, wherein, in the solution treatment, the material is heated to a temperature in a range of 950 to 1100° C. and is thereafter cooled to 700° C. at an average cooling rate of equal to or greater than 20° C./min.

In addition, in the method of manufacturing a rotary machine component, it is more preferable that the average cooling rate be equal to or greater than 30° C./min.

According to the method of manufacturing a rotary machine component having the related configuration, as above, a rotary machine component which suppresses the precipitation of an embrittled phase and has high toughness may be manufactured by performing the solution treatment under the above conditions.

In the method of manufacturing a rotary machine component according to a ninth aspect of the present invention, after machining and a welding process as necessary is performed on the material, an annealing process is further performed at a temperature in a range of 530 to 570° C.

In the method of manufacturing a rotary machine component according to a tenth aspect of the present invention, a time taken to perform the annealing process is in a range of 1 to 12 hours.

According to the method of manufacturing a rotary machine component having the related configuration, by performing the annealing process under the above conditions, similarly to above, a rotary machine component in which the residual stress of the material is reduced and high toughness is provided may be manufactured.

In the method of manufacturing a rotary machine component according to an eleventh aspect of the present invention, the material is a discoid material and has a thickness of smaller than or equal to 300 mm.

In the method of manufacturing a rotary machine component according to a twelfth aspect of the present invention, the solution treatment is performed after forming a through-hole in the discoid material in a thickness direction.

According to the method of manufacturing a rotary machine component having the related configuration, as above, after the material is formed by directly forging an ingot which is a duplex stainless steel material to a shape having dimensions similar to those of the rotary machine component, various working processes are performed thereon. Therefore, a rotary machine component in which the precipitation of an embrittled phase is suppressed and of which the toughness is excellent and which has a considerable thickness and a large diameter may be configured.

A rotary machine component according to a thirteenth aspect of the present invention is manufactured according to the manufacturing method.

According to the rotary machine component having the related configuration, since the rotary machine component is obtained according to the manufacturing method, it is possible to obtain both low residual stress and high toughness.

A rotary machine according to a fourteenth aspect of the present invention includes the rotary machine component.

In a centrifugal compressor according to a fifteenth aspect of the present invention, the rotary machine component is an impeller, and the impeller is included.

According to the rotary machine and the centrifugal compressor having the related configuration, since the rotary machine component (impeller) obtained according to the manufacturing method is included, corrosion or stress corrosion cracking that occurs due to corrosive components is suppressed, and thus it is possible to prevent the occurrence of cracking and the like during operation.

Effects of Invention

According to the method of manufacturing a material for a rotary machine component and the method of manufacturing a rotary machine component according to the aspects of the invention, in the above configurations, it is possible to manufacture the material for a rotary machine component which suppresses the precipitation of an embrittled phase and has high toughness and the rotary machine component using the same. In addition, in a case where the annealing process is performed according to the manufacturing methods having the above configurations, it is possible to manufacture the material for a rotary machine component in which the residual stress of the material is reduced and high toughness is provided and the rotary machine component using the same.

In addition, according to the rotary machine and the centrifugal compressor according to the aspects of the present invention, since the rotary machine component and the impeller obtained according to the manufacturing methods are used, corrosion or stress corrosion cracking that occurs due to corrosive components is suppressed, and thus the occurrence of cracking and the like during machine operation may be prevented.

DESCRIPTION OF EMBODIMENTS

Hereinafter, a method of manufacturing a material for a rotary machine component, a method of manufacturing a rotary machine component, a material for a rotary machine component, a rotary machine component, and a centrifugal compressor according to an embodiment of the present invention will be described appropriately with reference to FIGS. 1 to 8 by exemplifying a method of manufacturing an impeller used in a centrifugal compressor.

In addition, the drawings referred in the following description are drawings for mainly describing the impeller (rotary machine component) used in the centrifugal compressor, and the sizes, thicknesses, and dimensions of illustrated elements may be different from actual dimensional relationships.

[Centrifugal Compressor (Rotary Machine)]

Figure 1:
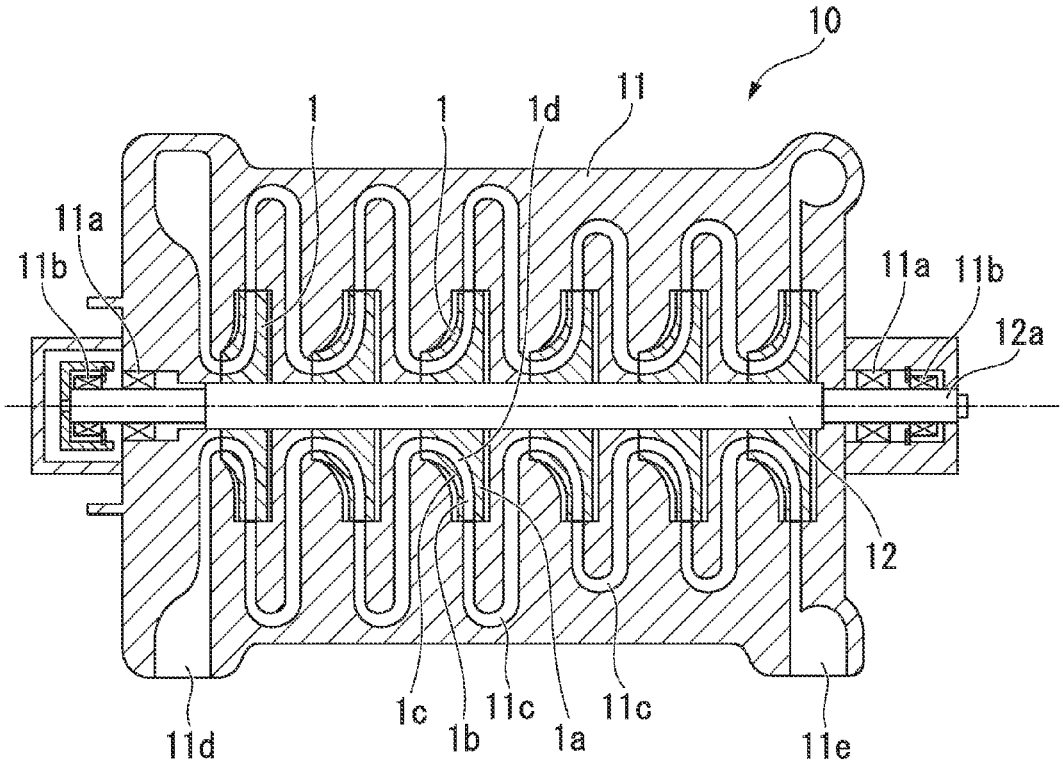
FIG. 1 is a diagram schematically illustrating examples of a method of manufacturing a material for a rotary machine component, a method of manufacturing a rotary machine component, a material for a rotary machine component, a rotary machine component, and a centrifugal compressor according to an embodiment of the present invention, and is a schematic cross-sectional view illustrating the centrifugal compressor which uses an impeller that is an example of the rotary machine component.

FIG. 1 is a cross-sectional view illustrating an example of the centrifugal compressor in which the impeller (rotary machine component) 1 obtained according to the manufacturing method in this embodiment is used. The centrifugal compressor 10 compresses a process gas G which is a fluid. The centrifugal compressor 10 includes a casing 11 which forms the outer enclosure, a rotor 12 which is rotatably supported by the casing 11 and is rotated by a driving unit (not shown), and a plurality of impellers 1 mounted to the rotor 12, on the same axis as that of the rotor 12 in the casing 11. Here, as the driving unit that rotates the rotor 12, various units such as an electric motor or a turbine may be selected according to applications.

In the centrifugal compressor 10 in the example illustrated in FIG. 1, a journal bearing 11*a* and a thrust bearing 11*b* are provided on each of both sides of the casing 11. A rotating shaft 12*a* of the rotor 12 is rotatably supported by the journal bearings 11*a* and the thrust bearings 11*b*. In addition, the casing 11 forms a plurality of operation chambers 11*c* which are continuous between the impellers 1 in the vicinities of the rotor 12 and the impellers 1, and on both sides thereof, a suction port 11*d* into which the process gas G flows and a discharge port 11*e* from which the process gas G flows out are provided to communicate with the operation chambers 11*c*.

In the centrifugal compressor 10 having the above configuration, the impellers 1 which compress the process gas G through a rotary motion are configured to come into contact with the process gas G that flows in from the suction port 11*d*, an aqueous solution in which the process gas G is dissolved, and the like.

[Impeller (Rotary Machine Component)]

In the example illustrated in FIG. 1, the impellers 1 are configured so that a plurality of blades 1*b* are radially provided to be erected from a substantially discoid main body portion 1*a* and a shroud 1*c* is mounted to the tip end of the blade 1*b*.

In addition, through flow channels 1*d* formed between the main body portions 1*a*, the shrouds 1*c*, and the blades 1*b* which are adjacent, the process gas G which is the fluid to be compressed is able to flow to the inside of a diameter direction and in the axial direction and be discharged toward the outside in the diameter direction.

As an impeller material that forms the impeller 1, generally, a high-strength metal material such as a stainless steel is selected because a high load is exerted during compression of the process gas G. In addition, as described later, in a case where the impeller material is used in an oil well environment in which a corrosive component is contained in the process gas G, it is preferable to employ a metal material which has both strength and corrosion resistance such as a duplex stainless steel. In addition, as the duplex stainless steel used in this embodiment, for example, there are materials corresponding to SUS329J1, SUS329J3L, and SUS329J4L.

The impeller 1 of this embodiment is obtained by performing at least machining and a welding process as necessary on a material for a rotary machine component obtained in a manufacturing method as described later, or according to a method of manufacturing a rotary machine component described later.

[Method of Manufacturing Material for Rotary Machine Component]

Hereinafter, the method of manufacturing a material for a rotary machine component of this embodiment will be described by exemplifying a material for forming the impeller 1 described above.

The method of manufacturing a material (see reference numeral A of FIG. 4) for a rotary machine component of this embodiment is a method of performing at least a solution treatment on a material made of a duplex stainless steel. The solution treatment is a method of heating the material at a temperature in a range of 950 to 1100° C. and thereafter cooling the resultant to 700° C. at an average cooling rate of 20° C./min or higher.

The material made of the duplex stainless steel used in the manufacturing method of this embodiment is not particularly limited, and it is preferable to use a material made of materials corresponding to SUS329J1, SUS329J3L, and SUS329J4L as described above in terms of strength and corrosion resistance.

In the manufacturing method of this embodiment, first, from an ingot made of the metal material, for example, a bar-like material called a bloom or a cylindrical material of which the thickness is set to a prescribed range as described later is formed. In addition, by performing various heat treatments as described as follows on the material, mechanical properties thereof are improved.

Here, the solution treatment described in this embodiment is a treatment of performing rapid cooling after performing high-temperature heating at a temperature unique to an alloy so as to cause an alloy element that is typically precipitated at a low temperature to be in a state of being dissolved in a basic metal element as a solid component, thereby improving mechanical properties of the alloy. The solution treatment is also called a solid-solution treatment or a quenching process. By performing such a solution treatment, it is possible to enhance the toughness of the metal material.

In addition, in a case of a stainless steel, a temperature for the high-temperature heating in the solution treatment is generally in a range of 950 to 1100° C., and it is considered that a temperature of about 1050° C. is more appropriate. In the manufacturing method of this embodiment, by performing the solution treatment by heating the material to the temperature, precipitation of an embrittled phase in the material due to 475° C.-embrittlement, σ embrittlement, or the like is suppressed, and thus a material for a rotary machine component having high toughness may be manufactured. When the heating temperature in the solution treatment is out of the temperature range, there is a possibility of the quenching effect as described above being less likely to be obtained.

In addition, in the solution treatment of this embodiment, the average cooling rate when the material subjected to the high-temperature heating to the temperature is cooled to 700° C. is preferably equal to or greater than 20° C./min, and more preferably equal to or greater than 30° C./min. By causing the average cooling rate in the solution treatment to the above rate, precipitation of a σ embrittled phase may be effectively suppressed compared to a case of a low average cooling rate, and thus it is possible to enhance the toughness of the material (see the graphs shown in FIGS. 6 and 7). As a cooling method in this case, a water-cooling method may be employed without any limitations.

When the average cooling rate in the solution treatment is less than 20° C./min, the a embrittled phase precipitated in the material is increased, resulting in the degradation in the toughness of the material.

In addition, in the method of manufacturing a material for rotary machine component of this embodiment, it is more preferable that after performing the solution treatment having the above conditions on the material, an annealing process is performed at a temperature in a range of 530 to 570° C. By performing the annealing process on the material under the temperature conditions, it is possible to manufacture a material for a rotary machine component in which the residual stress of the material is reduced and which has high toughness.

The inventors intensively examined the annealing process in a manufacturing process of the material for a rotary machine component. As a result, as shown in the graph of FIG. 3, it was found that by causing the temperature in the annealing process to be in a range of 530 to 570° C., high material toughness may be ensured and residual stress is sufficiently reduced.

Figure 3:
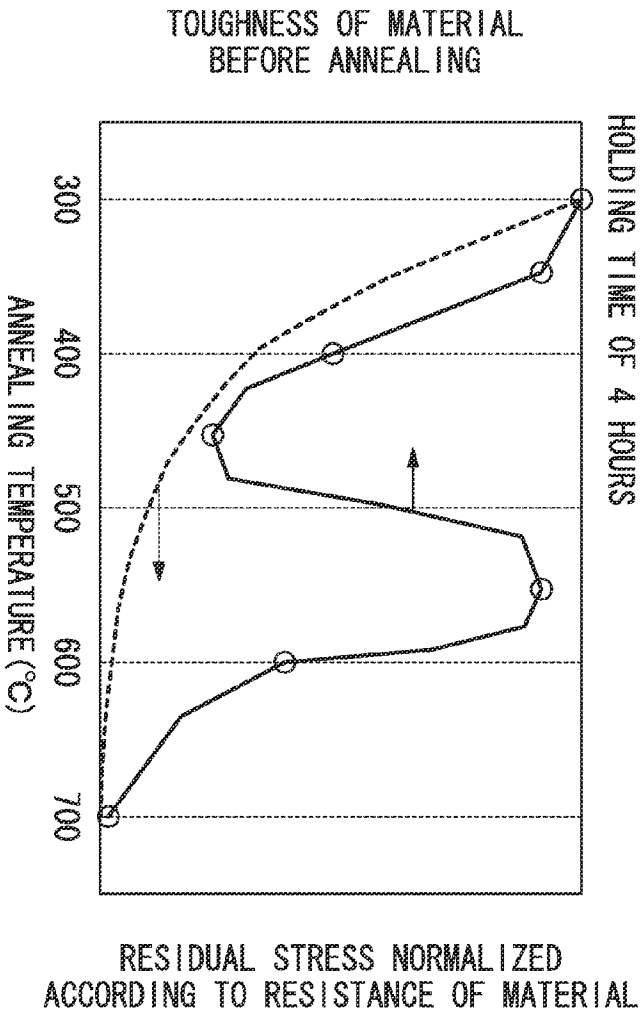
FIG. 3 is a diagram schematically illustrating the examples of the method of manufacturing a material for a rotary machine component, the method of manufacturing a rotary machine component, the material for a rotary machine component, the rotary machine component, and the centrifugal compressor according to the embodiment of the present invention, and is a graph showing the relationship between the toughness of the material and the residual stress with respect to annealing temperature.

When the temperature of the annealing process is less than 530° C., as shown in FIG. 3, the toughness of the material is increased. However, residual stress is not reduced, and there is a possibility of a material having low strength properties being manufactured. In addition, when the temperature of the annealing process is higher than 570° C., although the residual stress in the material is reduced, toughness is also reduced. Therefore, there is a possibility of cracking and the like being likely to occur during the manufacturing process or during operation.

In addition, it is appropriate that the temperature in the annealing process is about 550° C. because the above effect is more stably obtained.

In addition, a time taken to perform the annealing process under the temperature condition is preferably in a range of 1 to 12 hours, and more preferably, in a range of 4 to 8 hours. By causing the temperature to be in the above range and causing the treatment time to be in the above range to perform the annealing process, the effects of both a reduction in the residual stress in the material and toughness enhancement as described above are stably obtained. In addition, it is more preferable that a time taken to perform the annealing process at this temperature is about 4 hours.

Figure 4:
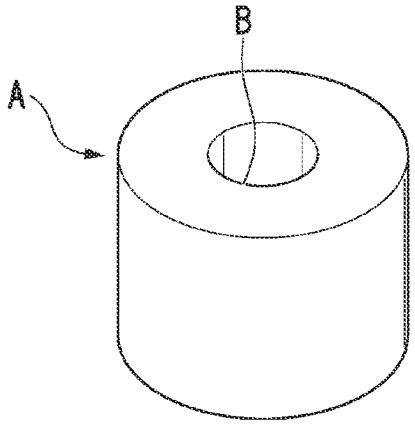
FIG. 4 is a diagram schematically illustrating the examples of the method of manufacturing a material for a rotary machine component, the method of manufacturing a rotary machine component, the material for a rotary machine component, the rotary machine component, and the centrifugal compressor according to the embodiment of the present invention, and is a schematic cross-sectional view illustrating the material for a rotary machine component in a case where the material is formed by directly forging a steel material ingot to a shape having dimensions similar to those of the rotary machine component.

In addition, in this embodiment, it is more preferable that the material made of the metal material is a discoid material and the thickness thereof is smaller than or equal to 300 mm (see a material A for a rotary machine component in FIG. 4).

The rotary machine component used in a rotary machine such as the impeller for the centrifugal compressor described in this embodiment typically has a thickness of smaller than or equal to about 300 mm in the rotating shaft direction. In this embodiment, first, after a material is formed by directly forging an ingot which is a duplex stainless steel material to a shape having dimensions similar to those of the impeller (rotary machine component) 1, the solution treatment having the above conditions is performed. Therefore, the solution (quenching) effects described above are more easily obtained. Accordingly, the material A for a rotary machine component in which precipitation of an embrittled phase is suppressed and of which the toughness is excellent and which is able to configure an impeller (rotary machine component) with a large thickness and a large diameter may be manufactured.

Hitherto, when a rotary machine component is manufactured, thin members formed by forging, machining, and the like are joined by welding. In this case, thin plates or bar-like blooms with small diameters are used as materials. Therefore, there is a low possibility of an embrittled phase being precipitated during forging and heat treatment stages of the materials. On the other hand, an impeller having a large diameter or an integration-type impeller having a flow channel hole processed requires a thick material. However, in this case, a cooling rate in the vicinity of the center of the thick material is reduced during a solution treatment, resulting in the precipitation of an embrittled phase. Therefore, the toughness of the rotary machine component is degraded, and there is a possibility of cracking and the like occurring during manufacturing or during operation after completion.

In the manufacturing method of this embodiment, first, the average cooling rate during the solution treatment is specified to a rate at which the precipitation of an embrittled phase is effectively prevented. In addition, in this embodiment, besides specifying the average cooling rate, it is more preferable to limit the maximum thickness of the material to 300 mm as a thickness with which the average cooling rate is able to be satisfied during quenching (cooling during the solution treatment) by water cooling or the like. By using such a material, it is possible to manufacture an impeller (rotary machine component) in which an embrittled phase is not precipitated and high toughness is provided.

Figure 5:
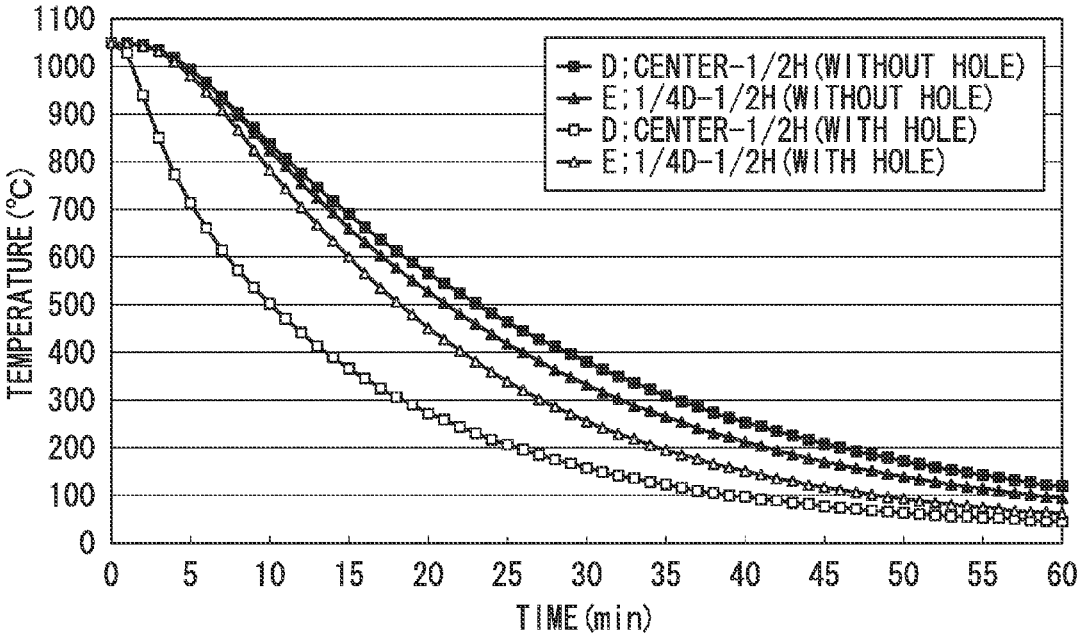
FIG. 5 is a diagram schematically illustrating the examples of the method of manufacturing a material for a rotary machine component, the method of manufacturing a rotary machine component, the material for a rotary machine component, the rotary machine component, and the centrifugal compressor according to the embodiment of the present invention, and is a cooling curve (cooling rate) graph showing the relationship between the treatment time and the temperature when the material for a rotary machine component is water-cooled.

Moreover, in this embodiment, as in the example illustrated in FIG. 4, it is more preferable that the solution treatment having the above conditions is performed on the discoid material A having the above dimensions and shapes after a through-hole (boss hole) B is formed therein in the thickness direction. As such, by forming the through-hole B in the discoid material A in advance, as shown in the graph of FIG. 5, the cooling rate is increased during the solution treatment. Therefore, an effect of suppressing the precipitation of an embrittled phase as described above is more stably obtained. In addition, in the graph of FIG. 5, two curves are shown for each of a case with the through-hole B and a case without a through-hole. This represents a case where a measurement position in the thickness direction of the material for a rotary machine component is changed.

[Method of Manufacturing Impeller (Rotary Machine Component)]

Hereinafter, a method of manufacturing an impeller (rotary machine component) of this embodiment will be described by exemplifying a case where the impeller 1 used in the centrifugal compressor 10 is formed as above. In addition, in the following description, detailed description of configurations which are common to the method of manufacturing a material for a rotary machine component of this embodiment described above, such as various heat treatment conditions, will be omitted.

The method of manufacturing an impeller (see the impeller 1 in FIG. 1 and an impeller intermediate product 1A of FIG. 2) of this embodiment is a method of performing machining and a welding process as necessary after performing at least a solution treatment on a material made of a duplex stainless steel. The solution treatment is a method of heating the material to a temperature in a range of 950 to 1100° C. and thereafter cooling the material to 700° C. at an average cooling rate of 20° C./min or higher.

The solution treatment in the method of manufacturing an impeller of this embodiment has the same conditions as those of the method of manufacturing a material for a rotary machine component described above. In this embodiment, a method of performing the solution treatment on the material under the conditions described above, and thereafter appropriately performing predetermined working processes, for example, machining, plastic working, and a welding process thereon so as to form the impeller 1 is provided. Therefore, the impeller 1 which suppresses the precipitation of an embrittled phase in the material due to 475° C.-embrittlement, σ-embrittlement, or the like and has high toughness may be manufactured. In addition, in this embodiment, it is more preferable that the average cooling rate during the solution treatment is equal to or greater than 30° C./min.

In addition, in this embodiment, it is more preferable that after performing the predetermined working processes as described above on the material after being subjected to the solution treatment, an annealing process be performed at a temperature in a range of 530 to 570° C. which is the same condition as that of the method of manufacturing a material for a rotary machine component described above. In addition, it is more preferable that a time taken to perform the annealing process at the temperature is in a range of 1 to 12 hours.

By employing such a method, it is possible to manufacture the impeller 1 in which the residual stress in the material that forms the impeller 1 is reduced and high toughness is provided.

Furthermore, in this embodiment, it is more preferable that the material is a discoid material and the thickness thereof is smaller than or equal to 300 mm, as in the method of manufacturing a material for a rotary machine component described above. In this embodiment, a method of directly performing a forging process on a metal material into a discoid shape which is close to the shape of the impeller 1 from an ingot without performing cooling part way to cause the material to have dimensions in the thickness direction of 300 mm at the maximum, and thereafter performing a solution treatment and various working processes, thereby manufacturing the rotary machine component is provided. Therefore, it is possible to form the impeller shape without limitations on shapes in the diameter direction. In addition, according to this embodiment, as above, the cooling rate and the temperature distribution do not vary during the solution treatment, and it is possible to manufacture the impeller (rotary machine component) 1 in which the precipitation of an embrittled phase is suppressed and excellent toughness is provided.

Moreover, in this embodiment, as above, as in the example illustrated in FIG. 4, it is preferable to perform the solution treatment having the above conditions after forming the through-hole B in the discoid material A in the thickness direction. By employing this method, as above, the cooling rate is increased during the solution treatment. Therefore, the effect of suppressing the precipitation of an embrittled phase as described above is more stably obtained.

Figure 2:
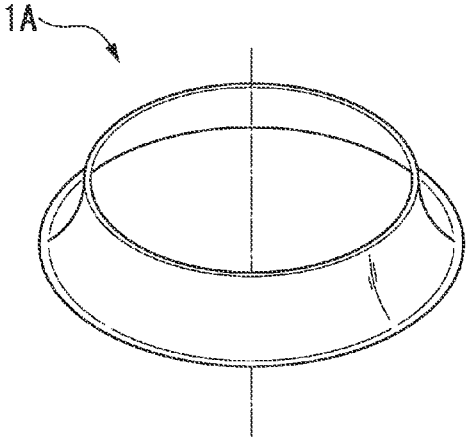
FIG. 2 is a diagram schematically illustrating the examples of the method of manufacturing a material for a rotary machine component, the method of manufacturing a rotary machine component, the material for a rotary machine component, the rotary machine component, and the centrifugal compressor according to the embodiment of the present invention, and is a schematic perspective view illustrating an intermediate product state of the impeller that is included in the centrifugal compressor illustrated in FIG. 1 and is the example of the rotary machine component.

In the method of manufacturing the impeller 1 of this embodiment, working processes such as machining, plastic working, a welding process, and the like as well as various heat treatments are performed on the material made of the duplex stainless steel by the processes as described above to achieve rough working, thereby manufacturing the impeller intermediate product 1A as illustrated in FIG. 2.

In addition, in the manufacturing method according to this embodiment of the present invention, an ultrasonic flaw detection test (UT: ultrasonic test) and a magnetic flaw detection test (MT: magnetic test) are performed on the impeller intermediate product 1A obtained by the method. In addition, after gas flow-channel electric discharge machining and finish polishing are performed on the impeller intermediate product 1A, outer periphery machining is performed on the resultant, thereby forming the impeller 1 as illustrated in FIG. 1. In addition, after performing the magnetic flaw detection test (MT) as described above on the impeller 1 again, a balance spin test is performed as a final test. In the manufacturing method according to this embodiment of the present invention, the processes and the tests performed on the impeller intermediate product 1A, well-known methods according to the related art may be employed.

While the method of manufacturing a material for a rotary machine component, the method of manufacturing a rotary machine component, the material for a rotary machine component, the rotary machine component, the rotary machine, and the centrifugal compressor according to the embodiment of the present invention have been described in detail with reference to the accompanying drawings, the specific configurations in the present invention are not limited to the embodiment and may include design modifications and the like in a range without departing from the gist of the present invention.

In addition, in this embodiment, the impeller of the centrifugal compressor as described above is exemplified as the material for a rotary machine component and the rotary machine component, and the centrifugal compressor is described as the rotary machine. However, the present invention is not limited to this. For example, it is possible to apply the present invention to impellers, rotors, and the like included in various compressor pumps.

As described above, according to the method of manufacturing a material for a rotary machine component and the method of manufacturing a rotary machine component according to the embodiment of the present invention, it is possible to manufacture the material for a rotary machine component in which the precipitation of an embrittled phase is suppressed and high toughness is provided and the rotary machine component using the same. Moreover, in a case where the annealing process is performed according to the manufacturing methods, it is possible to manufacture the material for a rotary machine component in which the residual stress of the material is reduced and high toughness is provided and the rotary machine component using the same.

In addition, according to the rotary machine and the centrifugal compressor according to the embodiment of the present invention, the rotary machine component and the impeller obtained according to the manufacturing methods are used. Therefore, corrosion or stress corrosion cracking that occurs due to corrosive components is suppressed, and thus the occurrence of cracking and the like during machine operation may be prevented.

EXAMPLES

Hereinafter, Examples are shown to describe the method of manufacturing a material for a rotary machine component, the method of manufacturing a rotary machine component, the material for a rotary machine component, and the rotary machine component of the present invention in more detail. However, the present invention is not limited to Examples.

[Manufacture of Samples of Material (Rotary Machine Component) for Rotary Machine Component]

Example 1

In Example 1, first, materials corresponding to SUS329J1, SUS329J3L, and SUS329J4L (all are made by Daido Steel Co., Ltd.) were prepared as duplex stainless steels, and a forging process was performed on each of the ingots thereof, thereby manufacturing round bar-like blooms having a diameter of 300 mm. In addition, the blooms were first heated to a temperature of 1050° C. as the solution treatment, and thereafter were water-cooled from 1050° C. to 700° C. at an average cooling rate of 31° C./min that is equal to or greater than 30° C./min, thereby manufacturing samples of the material for a rotary machine component.

Example 2

In Example 2, first, as in Example 1, materials corresponding to SUS329J1, SUS329J3L, and SUS329J4L (all are made by Daido Steel Co., Ltd.) were prepared as duplex stainless steels, and a forging process was performed on each of the ingots thereof, thereby manufacturing samples of the material for a rotary machine component which are made of discoid materials having a thickness of 300 mm.

Example 3

In Example 3, first, materials corresponding to SUS329J4L (made by Daido Steel Co., Ltd.) were prepared as duplex stainless steels, and a forging process was performed on each of the ingots thereof, thereby manufacturing round bar-like blooms having a diameter of 300 mm. In addition, as in Example 1, the blooms were first heated to a temperature of 1050° C. as the solution treatment, and thereafter were water-cooled from 1050° C. to 700° C. at an average cooling rate of 31° C./min that is equal to or greater than 30° C./min. Then, an annealing process for stress removal was performed by holding the blooms at a temperature of 550° C. for 4 hours, thereby manufacturing samples of the material for a rotary machine component.

Example 4

In Example 4, first, materials corresponding to SUS329J4L (made by Daido Steel Co., Ltd.) were prepared as duplex stainless steels, and a forging process was performed on each of the ingots thereof, thereby manufacturing discoid materials having a thickness of 300 mm. In addition, as in Example 1, the blooms were first heated to a temperature of 1050° C. as the solution treatment, and thereafter were water-cooled from 1050° C. to 700° C. at an average cooling rate of 31° C./min that is equal to or greater than 30° C./min. Then, rough working was performed by various machining and welding processes, thereby forming impeller intermediate products as illustrated in FIG. 2. In addition, an annealing process for stress removal was performed by holding the impeller intermediate products at a temperature of 550° C. for 4 hours, thereby manufacturing impellers (rotary machine components).

Comparative Examples 1 to 4

In Comparative Examples 1 to 4, first, as in each of Examples, materials corresponding to SUS329J4L were prepared as duplex stainless steels, and a forging process was performed on each of the ingots thereof, thereby manufacturing round bar-like blooms having a diameter of 300 mm. In addition, the blooms were first heated to a temperature of 1050° C. as the solution treatment, and thereafter were water-cooled from 1050° C. to 700° C. at average cooling rates of 20° C./min, 25° C./min, 10° C./min, and ° C./min, respectively, thereby manufacturing samples of the material for a rotary machine component of corresponding Comparative Examples.

[Evaluation Test Items]

Evaluation tests for residual stress, σ-phase area ratio, and toughness as described as follows were appropriately performed on the samples of Examples 1 to 4 and Comparative Examples 1 to 4 manufactured in the above orders.

(Evaluation of Residual Stress)

Residual stress was evaluated by analyzing stress remaining in the samples of each of Examples and Comparative Examples through X-ray diffraction using an X-ray apparatus.

(Evaluation of Metal Structure: σ-Phase Area Ratio)

A σ-phase area ratio was inspected by microstructure observation using an optical microscope and image analysis.

(Evaluation of Toughness: Charpy Impact Value)

As an index representing toughness, a Charpy impact test as described as follows was performed. First, Charpy test specimens with V notches of 2 mm were collected from the samples. In addition, on the basis of the method according to JIS Z 2242, absorbed energy was measured by setting a test temperature to room temperature (23° C.), and an impact value [J/cm$^2$] was obtained by dividing the absorbed energy by the cross-sectional area of the bottom of the notch.

[Evaluation Results]

As results of the evaluation tests, it was confirmed that in each of the samples of the material for a rotary machine component and the impeller (rotary machine component) of each of Examples, as described as follows, residual stress was reduced, and toughness was excellent.

Figure 6:
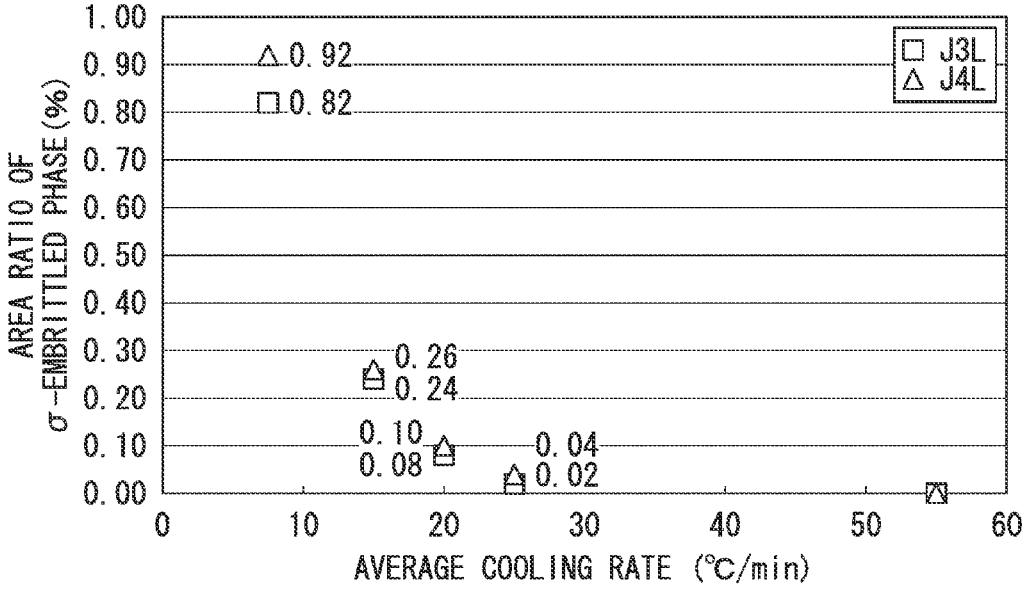
FIG. 6 is a diagram schematically illustrating the examples of the method of manufacturing a material for a rotary machine component, the method of manufacturing a rotary machine component, the material for a rotary machine component, the rotary machine component, and the centrifugal compressor according to the embodiment of the present invention, and is a graph showing the relationship between the average cooling rate and the area ratio of the σ phase (embrittled phase) of the material during the solution treatment.
Figure 7:
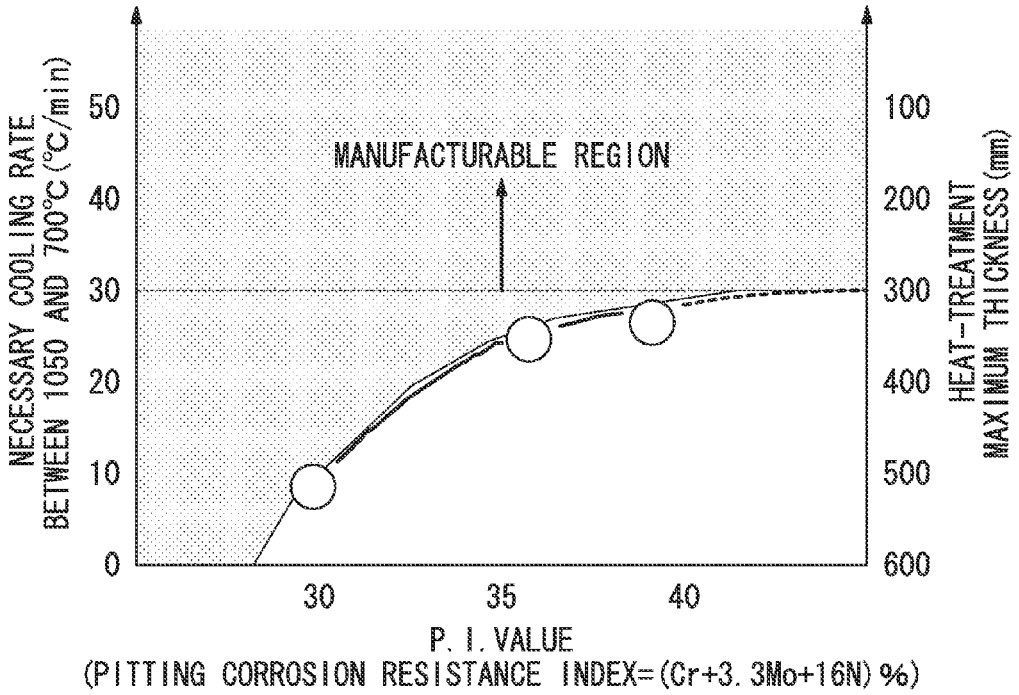
FIG. 7 is a diagram schematically illustrating the examples of the method of manufacturing a material for a rotary machine component, the method of manufacturing a rotary machine component, the material for a rotary machine component, the rotary machine component, and the centrifugal compressor according to the embodiment of the present invention, and is a graph showing the relationship between a necessary cooling rate between 1050° C. and 700° C., the heat-treatment maximum thickness, and the pitting corrosion resistance index (P. I. value).

In Example 1, the specification of the solution treatment of the present invention capable of reliably suppressing the precipitation of an embrittled phase was applied, and the material diameter was set to 300 mm which is the maximum material thickness that satisfies the specification. Accordingly, as shown in the graphs of FIGS. 6 and 7, a material for a rotary machine component in which embrittled phases are reduced and toughness is high is obtained. It is apparent that using the material for a rotary machine component, a rotary machine component such as the impeller having excellent toughness may be manufactured.

In Example 2, a method of directly forging the material into a disk which is close to the shape of the rotary machine component such as the impeller without performing cooling on the ingot part way is provided. Therefore, it is apparent that a material which has excellent toughness and does not limit the outside diameter of the component is obtained.

In Example 3, since the annealing process was performed at an appropriate temperature in addition to the solution treatment, when the residual stress and the structure shape of the material before and after annealing were examined, residual stress due to compression of the outer surface or tension of the inner surface, which was present at a time point of the solution treatment, was reduced to substantially 0 (zero).

Figure 8:
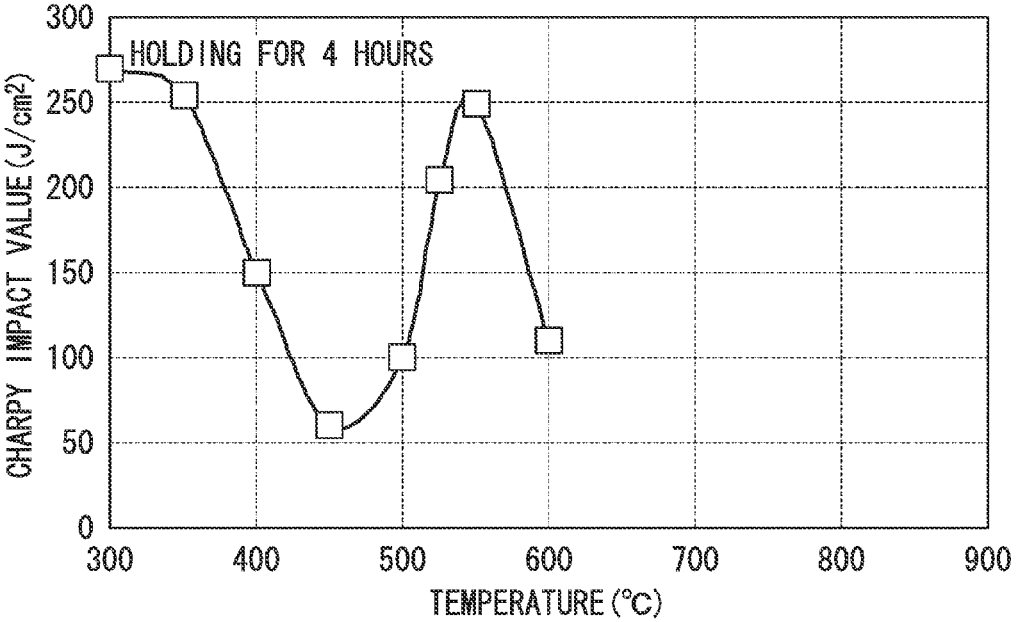
FIG. 8 is a diagram schematically illustrating the examples of the method of manufacturing a material for a rotary machine component, the method of manufacturing a rotary machine component, the material for a rotary machine component, the rotary machine component, and the centrifugal compressor according to the embodiment of the present invention, and is a graph showing the relationship between the annealing temperature and the Charpy impact value of the material.
Figure 9:
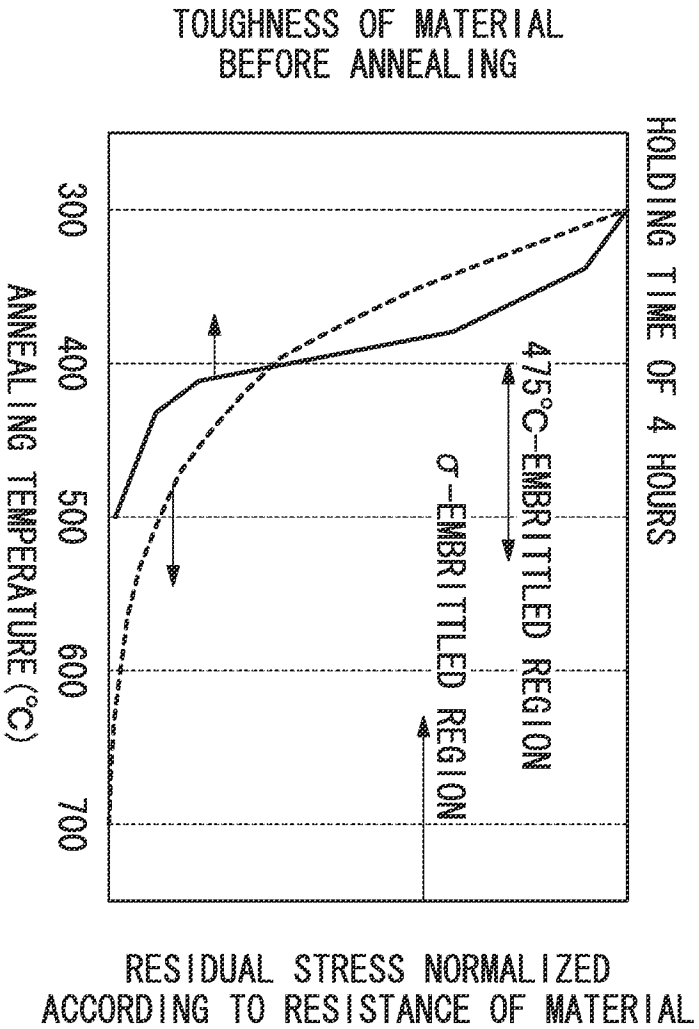
FIG. 9 is a diagram for explaining a method of manufacturing a material for a rotary machine component and a method of manufacturing a rotary machine component according to the related art, and is a graph showing the relationship between the toughness of the material and residual stress with respect to the annealing temperature.

In addition, it was confirmed that any of the precipitation of an embrittled phase after the annealing process, a 475° C.-embrittled phase, and a σ-embrittled phase was not present, and as shown in the graph of FIG. 8, the Charpy impact value after the annealing was about 250 (J/cm$^2$), which represents excellent toughness.

In Example 4, as in Example 3, since the annealing process was performed at an appropriate temperature in addition to the solution treatment, when the residual stress and the structure shape of the material before and after annealing were examined, residual stress due to compression of the outer surface or tension of the inner surface, which was present during welding, was reduced to substantially 0 (zero). In addition, it was confirmed that any of the precipitation of an embrittled phase after the annealing process, a 475° C.-embrittled phase, and a σ-embrittled phase was not present.

In addition, the samples of Comparative Examples 1 to 4 are examples in which average cooling rates were changed in the solution treatment. In the examples, Comparative Examples 1 and 2 are data of the example of the invention in which the average cooling rates were respectively 20° C./min and 25° C./min and thus the specification of the present invention was satisfied. Comparative Examples 3 and 4 are data of the example according to the related art in which the average cooling rates were respectively 10° C./min and 15° C./min. Here, as shown in the graph of FIG. 6, it was confirmed that any of the samples of Comparative Examples 1 and 2 in which the average cooling rates during the solution treatment satisfied the specification of the present invention had structures in which the area ratio of the σ-embrittled phase was suppressed to be less than or equal to 0.10% so as to be low and thus had excellent toughness. On the other hand, it was confirmed that the samples of Comparative Examples 3 and 4 in which the average cooling rates during the solution treatment were out of the specified range of the present invention resulted in larger σ-phase area ratios than those of Comparative Examples 1 and 2 and thus had degraded toughness.

Here, the graph of FIG. 7 is a graph representing the relationship between the P. I. values (pitting corrosion resistance indexes, PI=Cr+3.3Mo+16N %) of SUS329J1, J3L, and J4L which have different components although they are all duplex stainless steels, the minimum value of the cooling rate needed for preventing embrittlement, and the maximum thickness. As shown in FIG. 7, it can be seen that SUS329J1 is less likely to cause embrittlement and is not embrittled when the cooling rate is equal to or greater than 10° C./min; however, SUS329J3L and J4L need to be cooled at 20° C./min or higher, and more preferably, at 30° C./min or higher.

According to the results of each of the evaluation tests described above, it is apparent that the material for a rotary machine component and the rotary machine component obtained by the method of manufacturing a material for a rotary machine component and the method of manufacturing a rotary machine component according to the present invention have both low residual stress and high toughness. In addition, it is apparent that even in a case where a fluid containing corrosive components is supplied to the rotary machine and the centrifugal compressor which uses the rotary machine component, the occurrence of corrosion or stress corrosion cracking is suppressed.

INDUSTRIAL APPLICABILITY

According to the method of manufacturing a material for a rotary machine component and the method of manufacturing a rotary machine component according to the embodiments of the present invention, it is possible to manufacture a material for a rotary machine component which suppresses the precipitation of an embrittled phase and has high toughness and a rotary machine component using the same. Moreover, in a case where the annealing process is performed according to the manufacturing methods having the above configurations, it is possible to manufacture a material for a rotary machine component in which the residual stress of the material is reduced and high toughness is provided and a rotary machine component using the same.

In addition, according to the rotary machine and the centrifugal compressor according to the embodiments of the present invention, since the rotary machine component and the impeller obtained according to the manufacturing methods are used, corrosion or stress corrosion cracking that occurs due to corrosive components is suppressed, and thus the occurrence of cracking and the like during machine operation may be prevented.

REFERENCE SIGNS LIST

1 impeller (rotary machine component)
10 centrifugal compressor
A material for rotary machine component
B through-hole

The invention claimed is:

1. A method of manufacturing a material for a rotary machine component, by performing at least a solution treatment on a material made of a duplex stainless steel, wherein the material is a discoid material and has a thickness of smaller than or equal to 300 mm, wherein the solution treatment is performed after forming a circular through-hole in a center of the discoid material along a thickness direction thereof, wherein, in the solution treatment, the material is heated to a temperature in a range of 950 to 1100° C. and is thereafter cooled to 700° C. at an average cooling rate of equal to or greater than 20° C./min, wherein, after the solution treatment and a machining are performed on the material, an annealing process is further performed at a temperature in a range of 530 to 570° C., and wherein a time taken to perform the annealing process is in a range of 1 to 12 hours.

2. The method of manufacturing a material for a rotary machine component according to claim 1, wherein the average cooling rate in the solution treatment is equal to or greater than 30° C./min.

3. A material for a rotary machine component manufactured by the manufacturing method according to claim 1.

4. A rotary machine component obtained by performing a predetermined working process on the material for a rotary machine component according to claim 3.

5. A method of manufacturing a rotary machine component, by performing at least a solution treatment on a material made of a duplex stainless steel and thereafter performing a predetermined working process thereon, wherein the material is a discoid material and has a thickness of smaller than or equal to 300 mm, wherein the solution treatment is performed after forming a circular through-hole in a center of the discoid material along a thickness direction thereof, wherein, in the solution treatment, the material is heated to a temperature in a range of 950 to 1100° C. and is thereafter cooled to 700° C. at an average cooling rate of equal to or greater than 20° C./min, wherein, after the predetermined working process is performed on the material, an annealing process is further performed at a temperature in a range of 530 to 570° C., and wherein a time taken to perform the annealing process is in a range of 1 to 12 hours.

6. The method of manufacturing a rotary machine component according to claim 5, wherein the average cooling rate in the solution treatment is equal to or greater than 30° C./min.

7. A rotary machine component manufactured by the manufacturing method according to claim 5.

8. A rotary machine comprising the rotary machine component according to claim 4.

9. A centrifugal compressor comprising an impeller which is the rotary machine component according to claim 4.

* * * * *